US006655605B2

(12) United States Patent
Stoecklein et al.

(10) Patent No.: US 6,655,605 B2
(45) Date of Patent: Dec. 2, 2003

(54) VALVE FOR REGULATING FLUIDS

(75) Inventors: Wolfgang Stoecklein, Stuttgart (DE); Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 67 days.

(21) Appl. No.: 10/018,657

(22) PCT Filed: Mar. 20, 2001

(86) PCT No.: PCT/DE01/01056

§ 371 (c)(1),
(2), (4) Date: Mar. 11, 2002

(87) PCT Pub. No.: WO01/81755

PCT Pub. Date: Nov. 1, 2001

(65) Prior Publication Data

US 2002/0139946 A1 Oct. 3, 2002

(30) Foreign Application Priority Data

Apr. 20, 2000 (DE) ..... 100 19 766

(51) Int. Cl.[7] ..... F16K 31/02

(52) U.S. Cl. ..... 239/102.2; 239/584; 251/57; 251/129.04; 251/129.06

(58) Field of Search ..... 251/57, 129.04, 251/129.06; 239/96, 102.2, 533.4, 584; 137/627.5, 901

(56) References Cited

U.S. PATENT DOCUMENTS 4,560,871 A * 12/1985 Bowman et al. ..... 251/57
5,441,029 A * 8/1995 Hlousek ..... 123/446
5,875,764 A 3/1999 Kappel et al.
6,076,800 A * 6/2000 Heinz et al. ..... 251/129.06
6,142,443 A * 11/2000 Potschin et al. ..... 239/102.2
6,427,968 B1 * 8/2002 Stoecklein ..... 251/57

FOREIGN PATENT DOCUMENTS

| | | |
|---|---|---|
| DE | 198 44 996 A | 4/2000 |
| EP | 0 477 400 A | 4/1992 |
| EP | 0 816 670 A | 1/1998 |

* cited by examiner

*Primary Examiner*—John Bastianelli
(74) *Attorney, Agent, or Firm*—Michael J. Striker

(57) ABSTRACT

The invention relates to a valve for controlling fluids, having a piezoelectric unit (4) for actuating a valve member (3), with which a valve closing member (12) is associated that divides a low-pressure region (16) at system pressure from a high-pressure region (17). The valve member (3) has at least one first piston (9) and one second piston (11), between which a hydraulic chamber (13) is embodied. To compensate for leakage losses, a filling device (23) is used, which can communicate with the high-pressure region (17) and which has at least one channel-like hollow chamber (24), in which a solid body (25) is disposed, with a gap surrounding it, in such a way that on one end (25A) of the solid body (25), a line (26) branching off from the high-pressure region (17), and on its opposite end (25B) a leakage line (27) discharges into the hollow chamber (24), and that a line (29) leading to the hydraulic chamber (13) branches off along the length of the solid body (25), and the system pressure (p_sys) in the hydraulic chamber (13) is adjustable by geometric definition of the branching point (28) (FIG. 1).

20 Claims, 7 Drawing Sheets

VALVE FOR REGULATING FLUIDS

PRIOR ART

Figure 1:
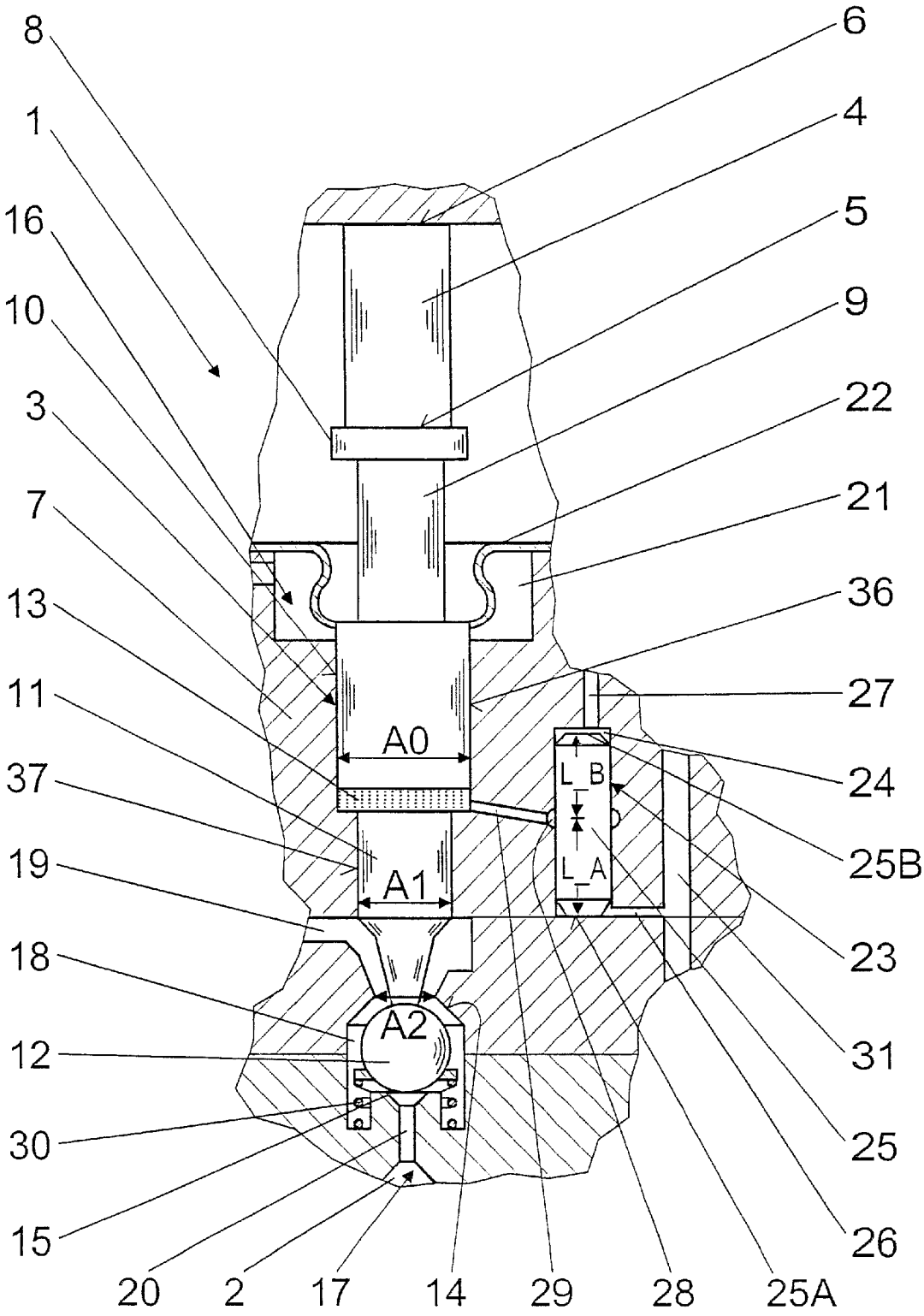

The invention is based on a valve for controlling fluids in accordance with the type defined in further detail in claim 1.

Such valves for controlling fluids, in which a valve closing member divides a low-pressure region in the valve from a high-pressure region, are well known in the industry, for example in fuel injectors, especially common rail injectors, or in pumps of motor vehicles.

European Patent Disclosure EP 0 477 400 A1 also describes such a valve; it is actuatable via a piezoelectric actuator and has an arrangement for a travel converter, acting in the stroke direction, of the piezoelectric actuator; the deflection of the actuator is transmitted via a hydraulic chamber, which serves as a hydraulic booster or coupling and as a tolerance compensation element. The hydraulic chamber encloses a common compensation volume between two pistons defining the hydraulic chamber, of which one piston is embodied with a smaller diameter and is connected to a valve closing member to be triggered, and the other piston is embodied with a greater diameter and is connected to the piezoelectric actuator. The hydraulic chamber is fastened between the pistons in such a way that the actuating piston executes a stroke that is lengthened by the boosting ratio of the piston diameter, when the larger piston is moved by a certain travel distance by means of the piezoelectric actuator. Via the compensation volume of the hydraulic chamber, tolerances resulting from temperature gradients or different temperature expansion coefficients of the materials used and possible settling effects, can be compensated for without thereby causing any change in the position of the valve closing member.

The hydraulic system in the low-pressure region, in particular the hydraulic coupler, requires a system pressure, which drops because of leakage, unless hydraulic fluid is adequately replenished.

To that end, in the industry, versions of common rail injectors are known in which the system pressure is expediently generated in the valve itself and should also be kept as constant as possible upon a system start, the filling of the system pressure region is assured by the delivery of hydraulic fluid from the high-pressure region of the fuel to be controlled into the low-pressure region where the system pressure is to prevail. This filling is often done with the aid of leakage gaps, which are represented by leakage or filling pins. The system pressure is as a rule adjusted by means of a valve, and the system pressure can also be kept constant for a plurality of common rail valves, for example, as well.

However, if the system pressure in the hydraulic chamber is substantially constant, and is at least largely independent of the prevailing high pressure in the high-pressure region, there is the problem that at high pressure values, great actuator force is required to open the valve closing member counter to the high-pressure direction, which in turn dictates a correspondingly large, cost-intensive dimensioning of the piezoelectric unit. Moreover, at high pressure in the high-pressure region, the positive displacement of hydraulic volume out of the hydraulic chamber via the gaps surrounding the adjacent pistons is reinforced accordingly, meaning that under some circumstances, the refilling time for building up and maintaining the counterpressure on the low-pressure region is prolonged, so that for lack of complete refilling, in the event of a re-actuation of the valve soon thereafter, a shorter valve stroke will be executed, which can adversely affect the opening behavior of the entire valve.

ADVANTAGES OF THE INVENTION

The valve for controlling fluids according to the invention, as defined by the characteristics of claim 1, has the advantage that the system pressure in the hydraulic chamber is variable, and its pressure level is dependent on the pressure prevailing in the high-pressure region. Thus at a high level in the high-pressure region, an increase of the system pressure in the hydraulic chamber is possible, as a result of which the actuating piston for opening the valve closing member counter to the prevailing high pressure is reinforced. In this way, a reduced triggering voltage of the piezoelectric unit suffices, compared to a valve with constant system pressure, and therefore the valve of the invention can be equipped with a smaller, less-expensive piezoelectric unit.

The invention furthermore enables a defined refilling of the low-pressure region, especially the hydraulic chamber. If the pressure in the high-pressure region is increasing, the refilling time can be shortened with the variable system pressure.

The embodiment according to the invention is distinguished by its structural simplicity, which makes it possible for the variable system pressure in the hydraulic chamber to be defined by means of easily adjustable geometrical variables, such as the longitudinal length of the solid body of the refilling device surrounding the gap flow between the high-pressure delivery and a branching point to the hydraulic chamber.

The solid body can be disposed essentially axially immovably in the hollow chamber.

In an especially advantageous version, it can also be provided that the solid body is disposed axially adjustably in the hollow chamber by means of a mechanical adjusting device, as a result of which influences of tolerance of valve components, specifically both an individual tolerance influence and the total influence of various components, can be mechanically corrected. The valve of the invention embodied in this way can advantageously be assembled without requiring that all the component sizes be adhered to exactly.

In a preferred application of the valve of the invention as a fuel injection valve, it is furthermore possible to meet the demand for the most precise possible preinjection quantity simply by checking the preinjection quantity after assembly, and if there is a deviation from the set-point quantity, a mechanical correction is made by way of the longitudinal mobility of the solid body of the filling device. This advantageously makes it unnecessary to replace parts, which is complicated and expensive.

Further advantages and advantageous features of the subject of the invention can be learned from the description, drawing and claims.

DRAWING

Figure 2:
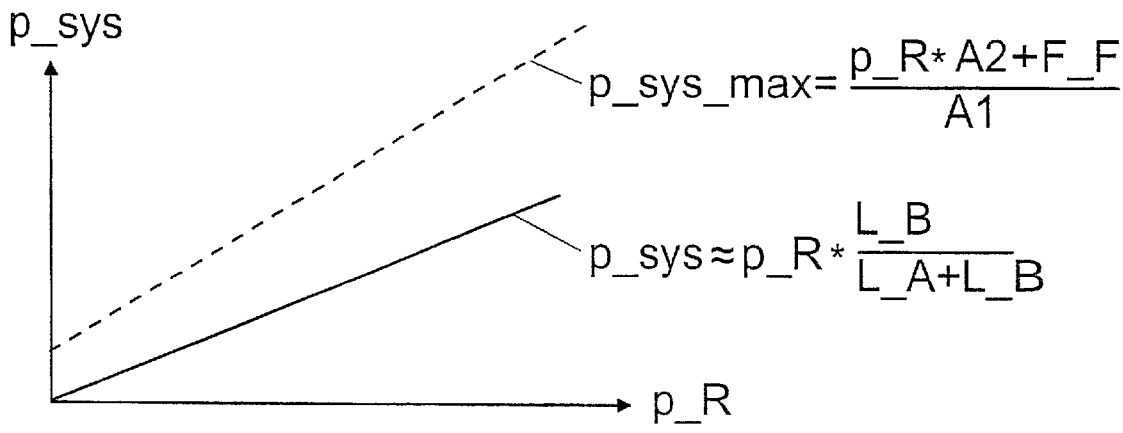
Figure 3:
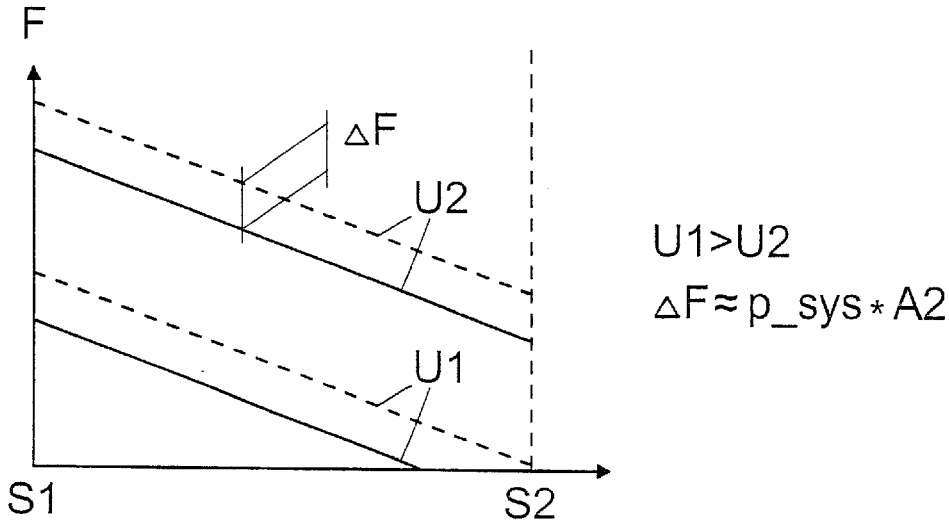
Figure 7:
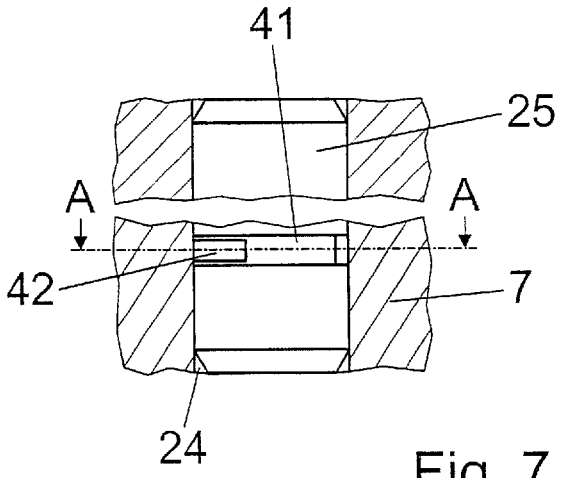
Figure 8:
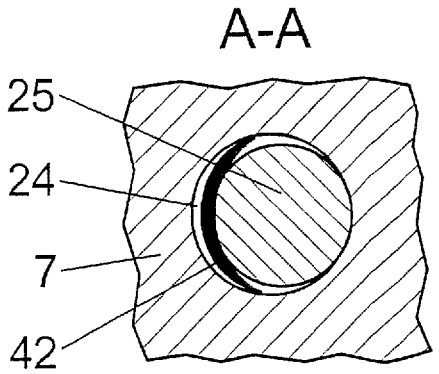
Figure 9:
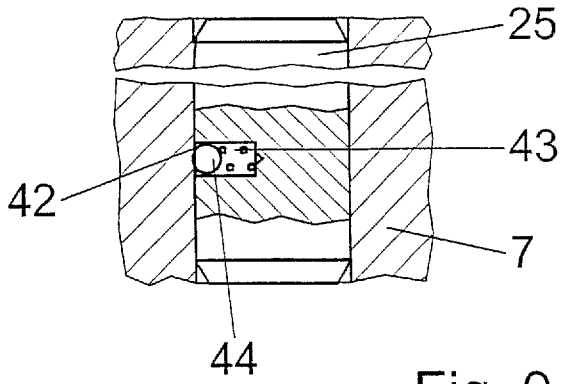
Figure 10:
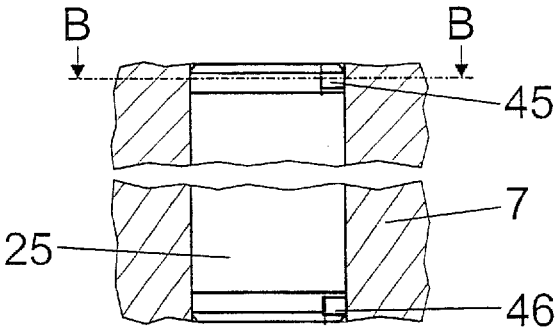
Figure 11:
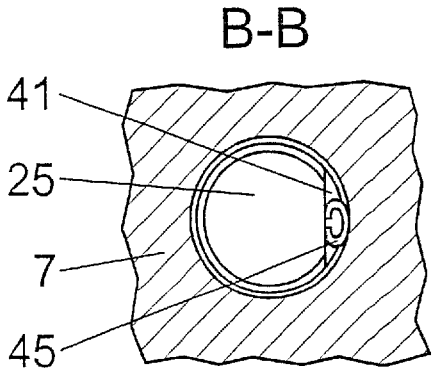
Figure 12:
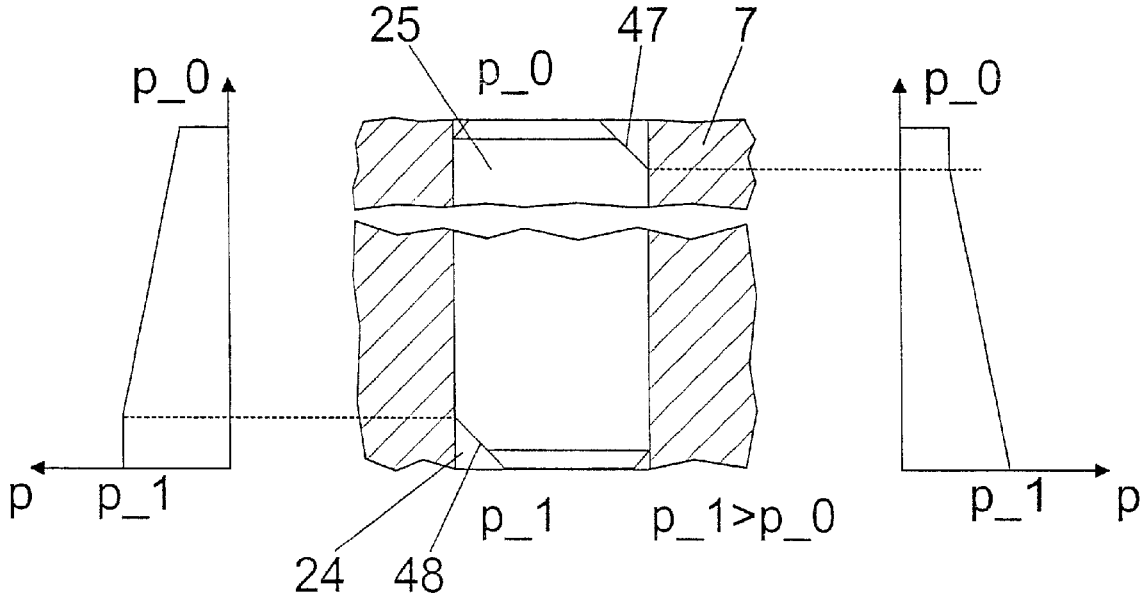
Figure 13:
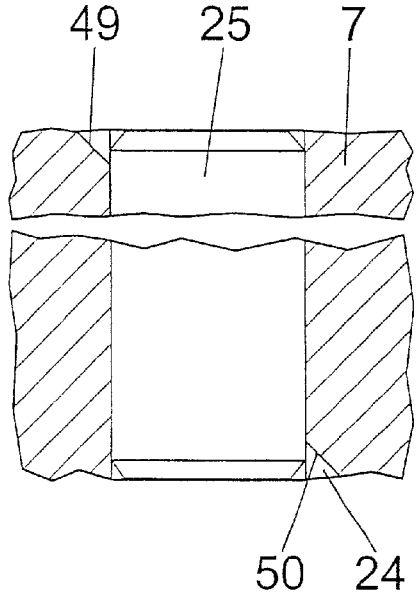
Figure 14:
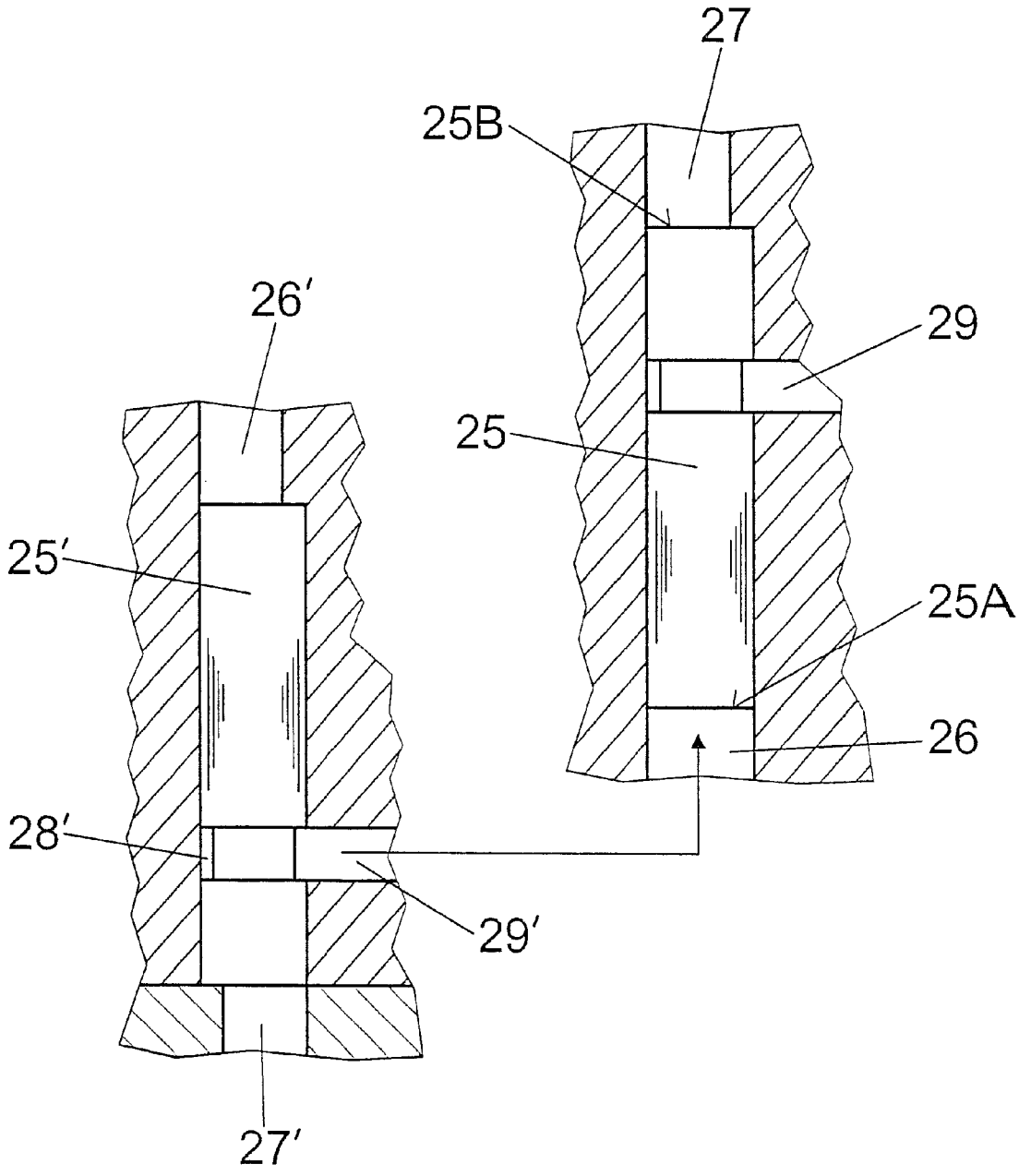

Several exemplary embodiments of the valve of the invention for controlling fluids are shown in the drawing and will be explained in further detail in the ensuing description. Shown are FIG. 1, a schematic, fragmentary view of a first exemplary embodiment of the invention for a fuel injection valve for internal combustion engines, in longitudinal section;

FIG. 2, a graph showing a highly simplified course of a system pressure of the low-pressure region as a function of the pressure in the high-pressure region;

FIG. 3, a graph with highly simplified courses of a force toward the valve of a piezoelectric unit of the valve of the invention in comparison with the course of the force for a valve with a constant system pressure in the low-pressure region;

FIGS. 4–7, each a schematic fragmentary view of a further exemplary embodiment of the invention in longitudinal section;

FIG. 8, a schematic cross section through the embodiment of FIG. 7;

FIGS. 9 and 10, each, a schematic fragmentary view of a further exemplary embodiment of the invention, in longitudinal section;

FIG. 11, a schematic cross section through the embodiment of FIG. 10; and FIGS. 12–14, each, simplified fragmentary views of further embodiments of the invention, in longitudinal section.

DESCRIPTION OF THE EXEMPLARY EMBODIMENTS

The exemplary embodiment shown in FIG. 1 illustrates a use of the valve of the invention in a fuel injection valve 1 for internal combustion engines of motor vehicles. In the present embodiment, the fuel injection valve 1 is embodied as a common rail injector for injecting Diesel fuel; the fuel injection is controlled via the pressure level in a valve control chamber 2, which communicates with a supply of high pressure.

For adjusting the injection onset, a duration of injection, and an injection quantity via force ratios in the fuel injection valve 1, a valve member 3 is triggered via a piezoelectric unit embodied as a piezoelectric actuator 4, which is disposed on the side of the valve member 3 remote from the valve control chamber and from the combustion chamber. The piezoelectric actuator 4 is constructed in the usual way in a plurality of layers, and on its side toward the valve member 3, it has an actuator head 5, while on its side remote from the valve member 3 it has an actuator foot 6, which is braced against a wall of a valve body 7. Via a support 8, a first piston of the valve member 3, which will be called a control piston, rests on the actuator head 5.

In addition to the first piston 9, the valve member 3, which is disposed axially displaceably in a longitudinal bore of the valve body 7, includes a further, second piston 11, which actuates a valve closing member 12 and will therefore also be called an actuating piston.

The pistons 9 and 11 are coupled to one another by means of a hydraulic booster. The hydraulic booster is embodied as a hydraulic chamber 13, which transmits the deflection of the piezoelectric actuator 4. The hydraulic chamber 13, between the two pistons 9 and 11 defining it, where the diameter A1 of the second piston 11 is less than the diameter of the first piston 9, encloses a common compensation volume, in which a system pressure p_sys prevails. The hydraulic chamber 13 is fastened between the pistons 9 and 11 in such a way that the second piston 11 of the valve member 3 executes a stroke that is lengthened by the boosting ratio of the piston diameter when the larger, first piston 9 is moved a certain travel distance by means of the piezoelectric actuator 4. The valve member 3, its pistons 9 and 11, and the piezoelectric actuator 4 are located one after the other on a common axis.

Via the compensation volume of the hydraulic chamber 13 tolerances resulting from temperature gradients in the component or different temperature expansion coefficients of the materials used and possible settling effects can be compensated for, without causing a resultant change in the position of the valve closing member 12 to be triggered.

On the end of the valve member 3 toward the valve control chamber 2, the ball-like valve closing member 12 cooperates with valve seats 14, 15 embodied on the valve body 7; the valve closing member 12 divides a low-pressure region 16 that is at the system pressure p_sys from a high-pressure region 17 that is at a high pressure or rail pressure p_R. The valve seats 14, 15 are embodied in a valve chamber 18, formed by the valve body 7, from which a leakage outlet conduit 19 leads away on the side of the valve seat 14 toward the piezoelectric actuator 4, and on the high-pressure side this valve chamber can be made to communicate with the valve control chamber 2 of the high-pressure region 17, via the second valve seat 15 and an outlet throttle 20.

In the valve control chamber 2, merely suggested in FIG. 1, there is a movable valve control piston, not identified by reference numeral. By axial motions of the valve control piston, the valve control chamber 2, which typically communicates with an injection line that communicates with a high-pressure reservoir (common rail) common to a plurality of fuel injection valves and that supplies an injection nozzle with fuel, the injection behavior of the fuel injection valve 1 is controlled in a manner known per se.

The end of the bore 10 toward the piezoelectric actuator is adjoined by a further valve chamber 21, which is defined on one side by the valve body 7 and on the other by a sealing element 22 connected to the first piston 9 of the valve member 3 and to the valve body 7. The sealing element 22 is embodied here as a bellows like diaphragm and prevents the piezoelectric actuator 4 from coming into contact with the fuel contained in the low-pressure region 16.

To compensate for leakage losses on the low-pressure region 16 upon an actuation of the fuel injection valve 1, a filling device 23 is provided, which discharges on the low-pressure region into the hydraulic chamber 13. The filling device 23 is embodied with a channel-like hollow chamber 24, in which a solid body 25, which is embodied in the form of a cylindrical pin, is disposed with a gap surrounding it, in such a way that a line 26 branching off from the high-pressure region 17 discharges into a region of the hollow chamber 24 on one end 25A of the solid body 25, and a leakage line 27 discharges into a region of the hollow chamber 24 on the opposite end 25B of the pin 25. Along the length of the pin 25, a line 29 leads from a branching point 28 to the hydraulic chamber 13.

The system pressure p_sys in the hydraulic chamber 13 can be adjusted geometrically by way of the disposition of the branching point 28 along the length of the pin 25. The system pressure p_sys in the hydraulic chamber 13 is thus withdrawn at a certain lengthwise segment of the pin 25, which is acted upon by rail pressure p_R on its lower end 25A and is relieved on its opposite end 25B, and this system pressure varies as a function of the pressure p_R prevailing in the high-pressure region.

In FIG. 2, the dependency of the system pressure p_sys on the rail pressure p_R is shown highly schematically. As can be seen here, at small gap sizes at the pistons 9 and 11, which are adjacent to the hydraulic chamber 13, the system pressure p_sys can be assumed to be a product of the high pressure p_R and the spacing l_B between the branching point 28 toward the hydraulic chamber 13 and the end 25B of the solid body or pin 25 where the leakage line 27 discharges into hollow chamber 24, refer to the total length of the pin 25. The static system pressure p_sys in the hydraulic chamber 13, which represents the coupler pressure, can thus be formally stated as follows:

$$p_sys = \frac{p_R * l_B}{(l_A + l_B)}$$

Along with the system pressure p_sys, which is attained after a certain refilling time after an injection, a maximum allowable system pressure or coupling pressure p_sys_max is also shown in FIG. 2, which pressure would lead to the automatic opening of the valve without triggering of the piezoelectric unit 4. This maximum allowable system pressure p_sys_max must not be exceeded, and therefore the branching point 28 of the line 29 to the hydraulic chamber 13 is geometrically defined such that the system pressure p_sys is always less than the maximum allowable system pressure p_sys_max. Furthermore, the gap sizes at the pistons 9 and 11 and at the pin 25 are adapted such that the maximum allowable system pressure p_sys_max is not exceeded.

The system pressure p_sys and the ratio of the spacing l_A between the branching point 28 toward the hydraulic chamber 13 and the end 25A of the pin 25, where the line 26 communicating with the high-pressure region 17 discharges into the hollow chamber 24, to the spacing l_B between the branching point 28 and the end 25B of the pin 25, where the leakage line 27 discharges into the hollow chamber 24, is dependent on a plurality of parameters, among which are the seat diameter A2 of the first valve seat 14 and the diameter A1 of the second piston or actuating piston 11. In the present case, in which the valve closing member 12 upon relief of the high-pressure region 17 is kept in the closing position against the first valve seat 14 by a spring force F_F of a spring 30 which is disposed between the valve closing member 12 and the second valve seat 15, the spring force F_F is a further parameter for the geometric definition of the branching point 28 of the line 29 toward the hydraulic chamber 13. The maximum allowable system pressure p_sys_max, which is shown in FIG. 2, can therefore be represented formally in simplified form as follows:

$$p_sys_max = \frac{p_R * A2 + F_F}{A1}$$

The line 26 branching off from the high-pressure region 17 communicates, in the present embodiment, with a high-pressure inlet 31 from a high-pressure pump 32 to the valve control chamber 2 in the high-pressure region 17.

In a departure from this, it can of course also be provided that the line 26 branching off from the high-pressure region 17 communicate fluidically with other regions in the high-pressure region 17, such as the valve control chamber 2 or the outlet throttle 20 or the valve chamber 18, in which the valve closing member 12 is movable between the valve seats 14 and 15, and which can also be integrated with a high-pressure line of the kind described for instance in German Patent Disclosure DE 198 60 678.8.

It can also be provided that the line 29 leading to the high-pressure region 17 not—as shown in FIG. 1—discharge directly into the hydraulic chamber 13 but rather into a gap 36 surrounding the first piston 9, and/or into a gap 37 surrounding the second piston 11. Such an embodiment is indicated, highly simplified, in FIG. 4. It can be seen that the line 29 leading from the branching point 28 to the hydraulic chamber 13 is divided into a first line 29A and a second line 29B, whose respective discharge regions into the gap 36 and the gap 37 is embodied as a filling groove 38, 39, respectively. With the pressure delivered via the pin 25, the filling grooves 38, 39 can each be supplied individually or in common.

It is understood that it can also be provided that only one of the lines 29A or 29B be present. The indirect filling of the hydraulic chamber 13 in each case serves to improve the pressure holding capacity in the hydraulic chamber during the triggering. However, care must be taken so that the flow quantity through the gaps 36, 37 is substantially less than the flow quantity at the pin 25, since then the furnished pressure depends only on the length ratios at the pin 25.

The fuel injection valve of FIG. 1 or FIG. 4 functions as described below.

In the closed state of the fuel injection valve 1, that is, when current is not supplied to the piezoelectric actuator 4, the valve closing member 12 rests on the upper valve seat 14 assigned to it and is acted upon, among other elements, by the spring 30 having the spring prestressing F_F. Above all, the rail pressure p_R is exerted on the valve closing member 12 and presses the valve closing member against the first valve seat 14.

In the case of a slow actuation, for instance as a consequence of a temperature-dictated change in length of the piezoelectric actuator 4 or other valve components, the first piston 9 acting as a control piston penetrates the compensation volume of the hydraulic chamber 13 in the event of temperature increases, and upon a temperature drop withdraws from it again, without this having any effect on the closing and opening position of the valve closing member 3 and of the fuel injection valve 1 overall.

If the valve is to be opened and an injection is to take place through the fuel injection valve 1, then the piezoelectric actuator 4 is supplied with current or subjected to voltage, which causes it to suddenly expand axially. In such a fast actuation of the piezoelectric actuator 4, this actuator is braced against the valve body 7 at this time and builds up an opening pressure in the hydraulic chamber 13. Not until the valve 1 is in equilibrium, as a result of coupler pressure or system pressure p_sys in the hydraulic chamber 13, does the second piston 11 move the valve closing member 12 out of its upper valve seat 14 into a middle position between the two valve seats 14 and 15. At a high rail pressure p_R, a greater force on the piezoelectric actuator side is required in order to reach the pressure of equilibrium in the hydraulic chamber 13. In the valve 1 of the invention, the pin 25 of the filling device 23 is therefore used, by way of which, if the rail pressure p_R is high, the pressure in the hydraulic chamber 13 is also elevated accordingly. In this way, for the same voltage applied to the piezoelectric actuator 4, the force on the piezoelectric actuator side exerted on the valve closing member 12 is increased, as shown in FIG. 3.

In FIG. 3, for a first voltage U1 and a second, lower voltage U2, the course of the force F_A of the piezoelectric actuator 4 on the valve closing member 12 at a variable system pressure p_sys according to the invention is shown with dot-dashed lines, while solid lines represent these voltages at a conventional static system pressure p_sys. It is demonstrated that with the variable system pressure p_sys of the invention, the piezoelectric actuator, at one and the same voltage, brings a greater force to bear upon motion of the valve closing member 12 from a position S1 at the first valve seat 14 to a position S2 at the second valve seat 15; the force increase ΔF results from the system pressure p_sys in the hydraulic chamber 13 and the diameter A1 of the second piston 11. The force increase ΔF is equivalent to a substantially higher voltage that would have to be applied to the piezoelectric actuator, since the force gain compared with a valve with a constant system pressure can amount to 20%, for instance. This force reserve gained can be utilized in designing the valve, for instance in order to reduce the size of the piezoelectric actuator.

When the valve closing member 12 has reached its second, lower valve seat 15 counter to the rail pressure p_R, the current supply to the piezoelectric actuator 3 is interrupted, whereupon the valve member 12 moves back into its middle position, and a fuel injection again takes place. At the same time, via the filling device 23, refilling of the hydraulic chamber 23 to the system pressure p_sys takes place.

Figure 4:
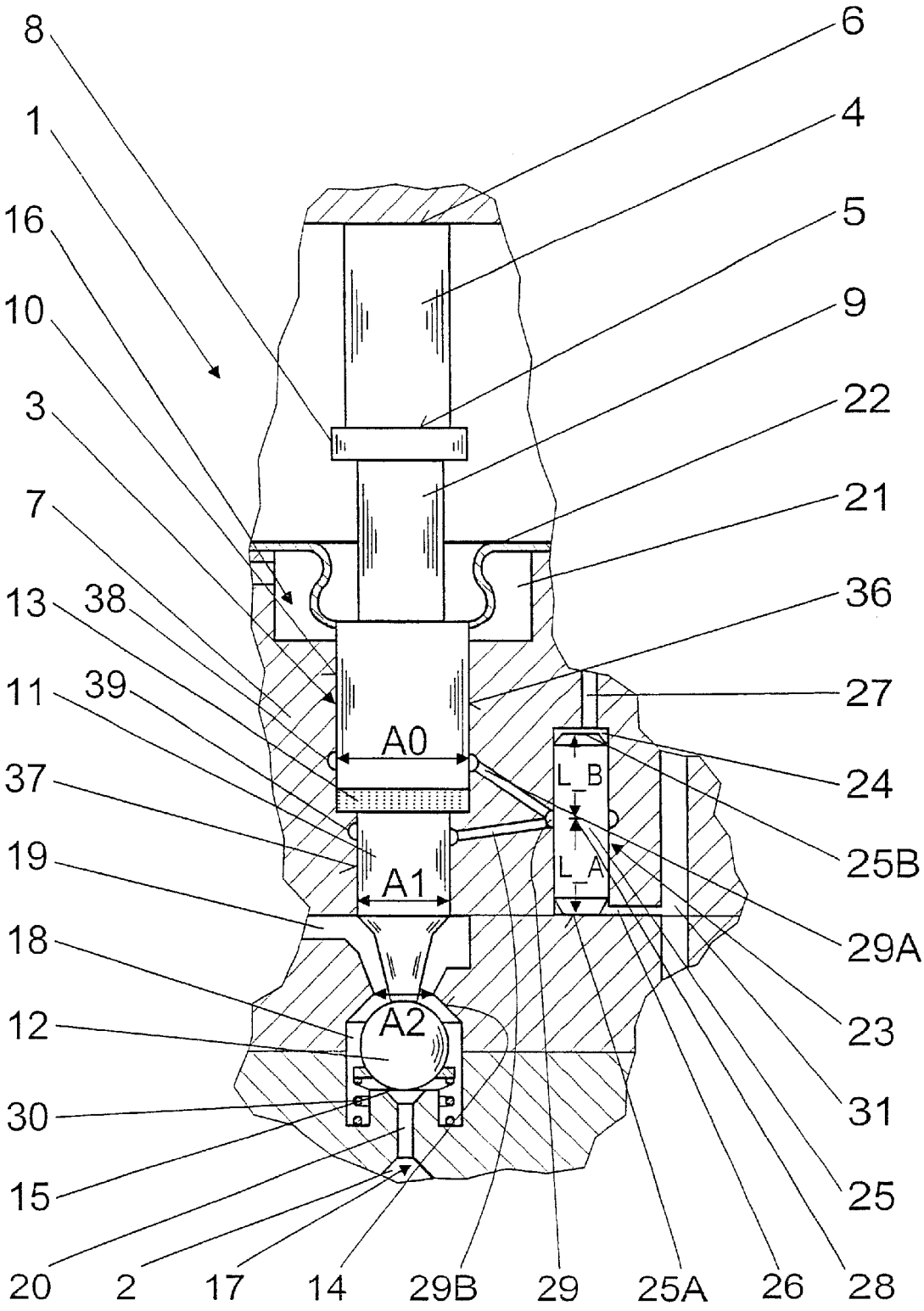
Figure 5:
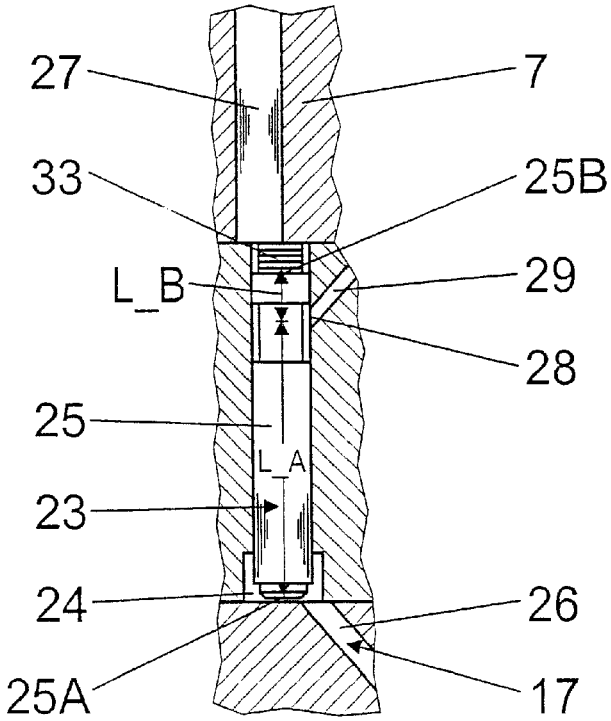

With reference to FIG. 5, a detail of a further exemplary embodiment of the fuel injection valve is shown; in principle, it functions like the fuel injection valve described in conjunction with FIGS. 1 and 4. For the sake of simplicity, functionally identical components are identified by the same reference numerals as in FIG. 1.

Compared to the version of FIG. 1, in which the solid body or pin 25 was disposed in the hollow chamber 24 of the filling device 23 indeed with play but essentially axially immovably, the solid body or pin 25 here, acting like a "pressure divider pin", is disposed axially adjustably by means of a mechanical adjusting device 32 in the hollow chamber 24. By means of the mechanical adjusting device 32, which in the version of FIG. 5 is embodied by adjusting shims 33 on its end 25B toward the leakage line 27, the pin 25 can be displaced in the hollow chamber 24. As a result, the system pressure p_sys diverted by the pin 25 to the hydraulic chamber 13 is varied, since the length ratios on the pin 25 shift.

If the piezoelectric actuator 4, in the version of FIG. 5, is supplied with current, the change in length as described above leads to an increase in the pressure in the hydraulic chamber 13; the buildup of pressure in the hydraulic chamber 13 in turn depends on various factors, such as a trigger gradient, the volume of the hydraulic chamber 13, and the deviation in the actuator ceramic. In fuel injection valves, preinjections are often performed with small injection quantities, which should be metered as precisely as possible. Since the actual preinjection quantity, because of various tolerance factors, does not often precisely match the precalculated preinjection quantity, in this embodiment a correction of the preinjection quantity can be done upon the motion of the valve closing member from its first valve seat 14 toward the second valve seat 15 in such a way that the injection time or the injection onset as well is varied by varying the system pressure p_sys.

Figure 6:
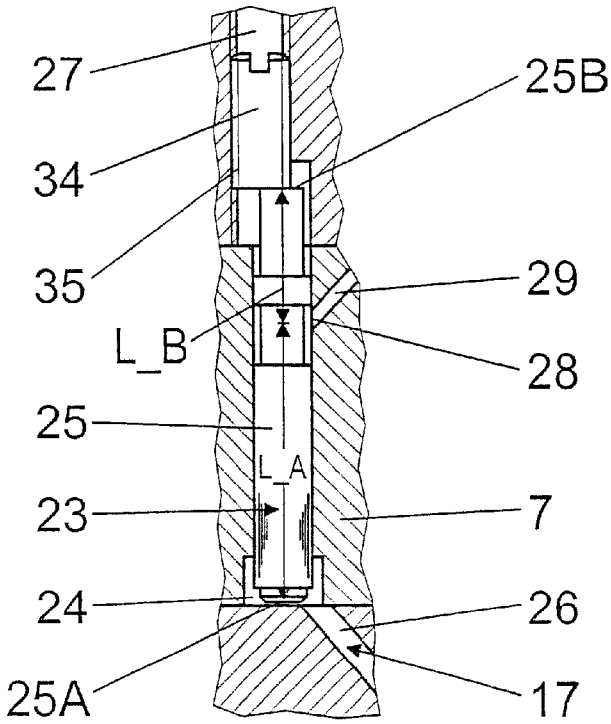

FIG. 6 shows a variant of the embodiment of FIG. 5, in which the mechanical adjusting device 32 for axial displacement of the pin 25 in the hollow chamber 24 of the filling device 23 is embodied with an adjusting screw 34, which can be adjusted externally in a thread 35 by means of a suitable screwdriver.

FIGS. 7–13 show further variant embodiments of the invention; here the pin 25 is disposed with a positioning device 40 in the hollow chamber 24.

As described above, the pin 25 is introduced into the bore of the hollow chamber 24 with a certain play, but the 30 precise location of the pin 25 remains unknown. The radial disposition of the pin 25 in the hollow chamber 24, however, according to empirical investigations, has an influence that should not be underestimated on the gap flow quantity and the exact function of the fuel injection valve. The division ratio between the lengths of the pin 25 with regard to where the branching point 28 is located is imprecise in the event of a skewed position of the pin 25, for instance. The flow quantity also varies, and given full eccentricity of the pin 25 it can be higher by the factor of 2.5 than in the case of an exactly central disposition of the pin 25. The positioning device 40 of the invention conversely makes a defined disposition of the pin 25 possible. Thus the flow is adjusted exactly, or the division ratio is adhered to precisely and the function of the injector thus becomes more exact.

In the versions of FIGS. 7–11, the pin 25 in each case is disposed eccentrically by means of at least one spring element, in such a way that it is braced by its long side on the wall of the hollow chamber 24.

In a second version of the positioning device 40 in FIGS. 7 and 8, the pin 25 can be provided with a groove 41 for this purpose. As the spring element, a sheet-metal strip 42 of resilient material rests in this groove 41 and is braced against the bore wall of the hollow chamber 24. The spring element 42 produces a force that presses the pin 25 against the wall. The pin 25 is thus located eccentrically in a defined way. The flow is now defined solely by the play between the pin 25 and the bore.

The version shown in FIG. 9 is essentially equivalent to the version of FIG. 7 or FIG. 8, but here the spring element is a helical spring 43, which rests in the groove 41 and presses against a ball 44.

As FIGS. 10 and 11 show, a spring element 45, 46 can also be provided in a respective flat face on both ends of the pin 25, in order to embody the positioning device 40.

However, the positioning device 40 can also be embodied as a respective pressure shoulder 47, 48 and 49, 50 disposed on one end of the pin 25, as the variant embodiments of FIGS. 12 and 13 show. The pressure shoulders 47, 48 and 49, 50 are offset from one another by 180° each and represent flat edges, which can be embodied on the pin 25, as shown in FIG. 12, or on the hollow chamber 24, as shown in FIG. 13. By two flat edges, mounted on the end of the pin 25 with a rotation of 180°, the resultant hydraulic force is utilized. As can be learned especially from FIG. 12 and the associated pressure courses, the fuel flows from bottom to top, if a pressure p_1 at the bottom is greater than a pressure p_0. Without the flat edges, a linear pressure course from p_1 to p_0 would be established on the pin surface. The flat edges have the effect that the pressure on the lower left side of the pin 25 is initially equal to p_1, while conversely the pressure on the lower right side is already linearly decreasing. The pin 25 is therefore pressed downward and to the right. At the top, the same is correspondingly true for the pin 25.

Aside from the problems of exact positioning of the pin 25, its structural length can sometimes also cause installation and production problems, if the pressure ratio of the high pressure p_R to the system pressure p_sys in the hydraulic chamber 13 is high.

It can therefore also be provided that a plurality of "pressure distributor pins", like the pin 25 shown in FIGS. 1–13, are present, by means of which the structural length of the individual pins can be reduced markedly compared with a single pin.

FIG. 14 shows one such variant embodiment, with two pins 25 and 25'; two hollow chambers 24, 24' with respective lines 26, 26' each carrying high pressure and with leakage lines 27, 27' are disposed serially in such a way that a line 29' leading to the hydraulic chamber 12 from the upstream hollow chamber 24' simultaneously forms the line 26, leading from the high-pressure region 17, that discharges into the downstream hollow chamber 24.

The versions described each pertain to a so-called double-seat valve, but the invention is understood to be applicable to single-switching valves having only one valve seat as well.

It is understood that the invention can also be used not only in the common rail injectors described here as the preferred field of use, but also in general in fuel injection valves, or in other fields as well, such as in pumps.

What is claimed is:

1. A valve for controlling fluids, having a piezoelectric unit (4) for actuating a valve member (3), which is axially displaceable in a valve body (7) and with which a valve closing member (12) is associated, which valve closing member cooperates with at least one valve seat (14, 15) for opening and closing the valve (1) and separates a low-pressure region (16) at system pressure from a high-pressure region (17), the valve member (3) having at least one first piston (9) and one second piston (11) between which a hydraulic chamber (13) functioning as a tolerance compensation element and as a hydraulic booster is embodied, and to compensate for leakage losses, a filling device (23) connectable to the high-pressure region (17) is provided, characterized in that the filling device (23) is embodied with at least one channel-like hollow chamber (24, 24'), in which a solid body (25, 25') with a gap surrounding it is disposed such that on end (25A) of the solid body (25, 25'), a line (26, 26') leading to the high-pressure region (17) discharges into the hollow chamber (24, 24'), and on the opposite end (25B) of the solid body (25, 25'), a leakage line (27, 27') discharges into the hollow chamber, and that a line (29, 29A, 29B, 29') leading to the hydraulic chamber (13) branches off along the length of the solid body (25, 25'), and the system pressure (p_sys) in the hydraulic chamber (13) is adjustable by geometric definition of the branching point (28) along the length of the solid body (25, 25').

2. The valve of claim 1, characterized in that the system pressure (p_sys) in the hydraulic chamber (13) is variable as a function of the pressure (p_R) prevailing in the high-pressure region (17), and the system pressure (p_sys) is the result essentially of the product of the high pressure (p_R) and the spacing between the branching point (28) to the hydraulic chamber (13) and the end (25B) of the solid body where the leakage line (27) discharges into the hollow chamber (24), refer to the total length (l_A+l_B) of the solid body (25).

3. The valve of claim 1, characterized in that the ratio of the spacing (l_A) between the branching point (28) to the hydraulic chamber (13) and the end (25A) of the solid body (25) where the line (26) communicating with the high-pressure region (17) discharges into the hollow chamber (24) and the spacing (l_B) between the branching point (28) to the hydraulic chamber and the end (25B) of the solid body (25) where the leakage line (27) discharges into the hollow chamber (24) is selected as a function of at least the following parameters: the seat diameter (A2) and the ratio of the diameter (A0+) of the first piston (9) to the diameter (A1) of the second piston (11).

4. The valve of claim 1, characterized in that a spring force (F_F) of a spring (30), which is disposed between the valve closing member (12) and a second valve seat (15) toward the high-pressure region (17) and which keeps the valve closing member (12) in the closing position against the first valve seat (14) upon relief of the high-pressure region (17), is one parameter for the geometric definition of the branching point (28) of the line (29) to the hydraulic chamber (13).

5. The valve of claim 1, characterized in that the branching point (28) of the line (29) to the hydraulic chamber (13) is geometrically defined such that the system pressure (p_sys) in the hydraulic chamber (13) is always than a maximum allowable system pressure (p_sys_max).

6. The valve of claim 5, characterized in that the maximum allowable system pressure (p_sys_max) of the hydraulic chamber (13) corresponds to a pressure at which an automatic valve opening without actuation of the piezoelectric unit (4) ensues.

7. The valve of claim 1, characterized in that the line (29, 29A, 29B) leading to the hydraulic chamber (13) leads into it via the gap (36), adjoining the hydraulic chamber (13) and surrounding the first piston (9), and/or the gap (37) surrounding the second piston (11).

8. The valve of claim 1, characterized in that the ratio of the gap sizes of the gap surrounding the solid body (25) and the gaps (36, 37) surrounding the first piston (9) and the second piston (11) is selected such that the maximum allowable (p_sys_max) in the hydraulic chamber (13) is not exceeded.

9. The valve of claim 1, characterized in that the filling device (23) has at least a second hollow chamber (24') with a solid body (25) disposed in it, and the hollow chambers (24, 24') with the respective solid bodies (25, 25') are disposed serially in such a way that the line (29') leading to the hydraulic chamber (13) from the upstream hollow chamber (24') forms the line (26), leading from the high-pressure region (17), for the downstream hollow chamber (24).

10. The valve of claim 1, characterized in that the line (26) to the high-pressure region (17) communicates fluidically with a high-pressure inlet (31) from a high-pressure pump (32) to a valve control chamber (2) in the high-pressure region (17), or with an outlet throttle (20) between the at least one valve seat (14, 15) and the valve control chamber (2) in the high-pressure region (17), or with a valve chamber (18), in which the valve closing member (12) is movable between a first valve seat (14) and a second valve seat (15).

11. The valve of claim 1, characterized in that the solid body (25) is disposed essentially axially immovably in the hollow chamber (24).

12. The valve of claim 1, characterized in that the solid body (25) is disposed axially adjustably in the hollow chamber (24) by means of a mechanical adjusting device (32).

13. The valve of claim 12, characterized in that the mechanical adjusting device is embodied with at least one adjusting shim (33) and/or with an adjusting screw (34) on at least one of the ends of the solid body (25).

14. The valve of claim 1, characterized in that the solid body (25) is disposed with a positioning device (40) for radial alignment in the hollow chamber (24).

15. The valve of claim 14, characterized in that the solid body (25) is disposed eccentrically by means of the positioning device (40) in such a way that it is braced by one long side against the wall of the hollow chamber (24).

16. The valve of claim 14, characterized in that the positioning device (20) has at least one spring element (42, 43, 45, 46) between a wall of the hollow chamber (24) and the solid body (25), and the spring element (42, 43, 45, 46) preferably engages a groove (41) of the solid body (25).

17. The valve of claim 14, characterized in that the positioning device (40) is embodied with a respective pressure shoulder (47, 48, 49, 50) disposed on one end of the solid body (25), and the pressure shoulders (47, 48, 49, 50) are offset from one another by at least approximately 180°.

18. The valve of claim 17, characterized in that the pressure shoulders (47, 48, 49, 50) are each shaped as flat edges on the solid body (25) or the hollow chamber (24).

19. The valve of claim 1, characterized in that the solid body (25, 25') is embodied as a cylindrical pin.

20. The valve of claim 1, characterized by its use as a component of a fuel injection valve for internal combustion engines, in particular of a common rail injector (1).

* * * * *